US008851697B2

(12) United States Patent
Quittner

(10) Patent No.: US 8,851,697 B2
(45) **Date of Patent: *Oct. 7, 2014**

(54) COMPACT FLASHLIGHT

(71) Applicant: Brian Quittner, Goleta, CA (US)

(72) Inventor: Brian Quittner, Goleta, CA (US)

( * ) Notice: Subject to any disclaimer, the term of this patent is extended or adjusted under 35 U.S.C. 154(b) by 90 days.

This patent is subject to a terminal disclaimer.

(21) Appl. No.: 13/624,062

(22) Filed: Sep. 21, 2012

(65) Prior Publication Data

US 2014/0085869 A1 Mar. 27, 2014

(51) Int. Cl.
*F21L 4/04* (2006.01)

(52) U.S. Cl.
USPC ..... 362/103; 362/200; 362/199

(58) Field of Classification Search
USPC ..... 362/103, 105, 108, 130, 205, 200, 253, 362/188
See application file for complete search history.

(56) References Cited

U.S. PATENT DOCUMENTS

| | | | |
|---|---|---|---|
| 3,953,722 | A | 4/1976 | Stick |
| 4,234,913 | A | 11/1980 | Ramme |
| 4,448,097 | A | 5/1984 | Rocca |
| 4,598,340 | A | 7/1986 | Dwosh et al. |
| 4,605,990 | A | 8/1986 | Wilder et al. |
| D292,616 | S | 11/1987 | Sexton |
| 4,953,892 | A | 9/1990 | Adkins |
| 4,974,130 | A | 11/1990 | Friedman |
| 5,029,055 | A | 7/1991 | Lindh |
| 5,183,324 | A | 2/1993 | Thomas |
| D340,777 | S | 10/1993 | Choi et al. |
| D350,618 | S | 9/1994 | Parker |
| 5,410,457 | A | 4/1995 | Parker |
| D362,312 | S | 9/1995 | Chen |
| 5,541,816 | A | 7/1996 | Miserendino |
| D383,558 | S | 9/1997 | Parker |
| 5,871,272 | A | 2/1999 | Sharrah et al. |
| 6,012,824 | A | 1/2000 | Sharrah et al. |
| 6,027,223 | A | 2/2000 | Lackey et al. |
| 6,213,618 | B1 | 4/2001 | Dobbin et al. |
| 6,250,771 | B1 | 6/2001 | Sharrah et al. |
| 6,254,249 | B1 | 7/2001 | Kim et al. |
| 6,299,323 | B1 | 10/2001 | Yu et al. |
| 6,474,830 | B1 | 11/2002 | Hansen |
| 6,523,972 | B2 | 2/2003 | Sharrah et al. |
| 6,533,436 | B2 | 3/2003 | Krietzman et al. |
| 6,612,714 | B1 | 9/2003 | Morre et al. |
| 7,048,403 | B2 | 5/2006 | Parker et al. |
| 7,306,348 | B2 | 12/2007 | Quittner |
| 7,513,662 | B2 | 4/2009 | Parker et al. |

(Continued)

OTHER PUBLICATIONS

Letter to Charles Berman, Esq., of Greenberg Traurig on Behalf of Pelican Products, Inc., Dated Jul. 10, 2008.

(Continued)

*Primary Examiner* — Ali Alavi
(74) *Attorney, Agent, or Firm* — David G. Duckworth; Russo & Duckworth, LLP

(57) ABSTRACT

A compact flashlight that allows a user to view documents in a dark situation without having to hold a flashlight. The pocket light fits easily over the top of the pocket and can be covered by a conventional pocket flap. The light is an LED display device that produces a significant amount of light so a user can check identification or documentation, as in a license check, or registration verification for police. The pocket light has a push button power switch that can be activated by the user through the fabric of their shirt.

10 Claims, 4 Drawing Sheets

(56) References Cited

U.S. PATENT DOCUMENTS

| | | | | |
|---|---|---|---|---|
| 7,731,392 | B2 | 6/2010 | Parker et al. | |
| 7,862,193 | B1 * | 1/2011 | Quittner | 362/103 |
| 8,282,233 | B2 * | 10/2012 | Quittner | 362/103 |
| 2002/0163800 | A1 | 11/2002 | Hansen | |

OTHER PUBLICATIONS

Photographs of VB3 Flashlight Sold by Pelican Products, Inc., Believed to Have Been on Sale by Nov. 1, 2004.

* cited by examiner

COMPACT FLASHLIGHT

RELATED APPLICATIONS

This application is a continuation-in-part of U.S. patent application Ser. No. 13/136,151 filed on Jul. 25, 2011, which in turn is a continuation of U.S. patent application Ser. No. 12/948,979 filed on Nov. 18, 2010, which in turn is a continuation of Ser. No. 12/355,849 now U.S. Pat. No. 7,862,193, which is a continuation of U.S. patent application Ser. No. 11/953,708 now U.S. Pat. No. 7,497,584, which is a continuation of U.S. patent application Ser. No. 11/271,227 now U.S. Pat. No. 7,306,348, which is a continuation-in-part of U.S. patent application Ser. No. 10/248,064 now U.S. Pat. No. 7,027,783.

BACKGROUND OF THE INVENTION

1. Field of the Invention

The present invention is a compact flashlight that has an attachment means for fitting on a shirt pocket.

2. Description of Related Art

The use of flashlights is imperative to security guards and police for patrolling and checking identification and documentation. Often the police officer or security guard carries the flashlight on his belt in a holster clip. However in this situation the user must unhook the flashlight, and position the flashlight in a proper position to se the documentation. Often this includes tucking the flashlight in the fold of the arm at the armpit against the body. The inherent problem with this situation includes lack of use of the hand on the arm holding the flashlight, or trying to juggle documentation and the flashlight in the same hand, or having no hands free while holding the documentation in one hand and the flashlight in the other hand.

U.S. Pat. No. 3,953,722 issued to Stick on Apr. 27, 1976 shows a flashlight support means. Stick's invention is unlike the present invention because it is attached to the wearer by a safety pin, it is larger than the present invention, and the light would not fit under a shirt pocket flap.

U.S. Pat. No. 4,605,990 issued to Wilder, et al. on Aug. 12, 1986 shows a surgical clip-on light pipe illumination assembly. Wilder's invention is unlike the present invention because the clip is a hinged mechanism that is not as discreet or hidden as the present invention, and the light mechanism cannot be hidden under a shirt or pocket flap.

U.S. Design Pat. No. D292,616 issued to Sexton on Nov. 3, 1987 shows a disposable clip light. Sexton's invention is unlike the present invention because when clipped it could not light in a downward direction as is needed to read documentation, and cannot fit underneath a shirt pocket flap.

U.S. Pat. No. 5,029,055 issued to Lindh on Jul. 2, 1991 shows a portable light. Lindh's invention is unlike the present invention because it is intended to be mounted on a bicycle, would not clip onto a shirt pocket, and would not be covered by a flap on a shirt pocket.

U.S. Design Pat. No. D340,777 issued to Choi, et al. on Oct. 26, 1993 shows a personal safety light. U.S. Design Pat. No. D362,312 issued to Chen on Sep. 12, 1995 shows a clip-on flashlight. Choi and Chen's inventions are unlike the present invention because they are bulkier, and cannot be easily hidden by a pocket flap as the present invention.

U.S. Pat. No. 4,953,892 issued to Adkins on Sep. 4, 1990 shows a ski pole clip. Adkins' invention is unlike the present invention because it does not have a light mechanism, and it would not fit in a pocket to light identification or documentation.

U.S. Pat. No. 5,541,816 issued to Miserendino on Jul. 30, 1996 shows a clip light source. Miserendino's invention is unlike the present invention because it is a flashlight intended to be attached to a helmet as for a miner or fireman, it cannot be covered by a shirt pocket flap, and it has a hinged mechanism for the light that is bulkier than the present invention.

U.S. Pat. No. 6,027,223 issued to Lackey, et al. on Feb. 22, 2000 shows a writing instrument pocket clip light. Lackey's invention is unlike the present invention because it is a writing instrument, and the light needs to be activated by unfolding the pen clip requiring additional hand coordination.

Therefore, a need has been established for a flashlight that can be hidden by a shirt pocket flap, which can assist policemen or security officers in viewing documents.

SUMMARY OF THE INVENTION

The present invention is a light that an officer or security guard could wear on his shirt pocket that projects a light in a downward direction. The light is compact and fits in a shirt pocket with a clip mechanism. The main body of the pocket light will fit inside a shirt pocket and there is a 1⅜ inch overlap from the front of the pocket that holds the light source. The pocket light mechanism is completely concealed within the user's pocket and cannot be seen on the wearer until the lights source is turned on, which is advantageous because it allows an officer to conform his appearance to the approved regulation appearance of his department. The main body of the light source encases the power source for the light and a push switch for turning the light on or off. In this manner the user can turn on the light and view any documents or light his way in a dark area, such as theater isle. The present invention is useful to police officers, security guards, ushers, and bouncers at nightclubs or the like.

The light projects at an approximate 30 degree outward and downward angle. Due to the approximate 30 degree angle the user can hold the documents that need to be read or viewed in his hand at a natural angle without having to place the documents directly underneath the light. Additionally, a hinged member allows the user to move the light up to a 90 degree angle or even up to a 180 degree angle from the main body of the pocket light, allowing for different angles of viewing capacity for the user. Although the light bulb is small and compact, the projection ray of the light is wide enough to project onto a letter sized document easily, and concentrated to make small print reading easier.

Advantages to the present invention include hands free use and quick access to a light source. The user can turn on the light through his shirt pocket with the push of a finger and the light can project easily from the underside of the shirt pocket flap allowing the user to have both hands free for handling documents. Currently, with conventional flashlights the user must keep one hand free to operate the flashlight and to hold the flashlight during use.

Exemplary embodiments of the invention will be further described below with reference to the drawings, in which like numbers refer to like parts.

DETAILED DESCRIPTION OF THE DRAWINGS

DETAILED DESCRIPTION OF THE INVENTION

The present invention is a pocket light for viewing documents or merely lighting one's way without having to use a hand held flashlight. The pocket light is small and thin in size to easily fit in any shirt pocket and still leave room for other items. An exemplary embodiment of the present invention is preferably made of a high-density or composite type plastic shell casing; a pair of batteries; a power button; a Light Emitting Diode (LED) lame emitting red, blue or white light; and a flap mechanism for securing the present invention to a pocket in a secure yet removable fashion.

Figure 1:
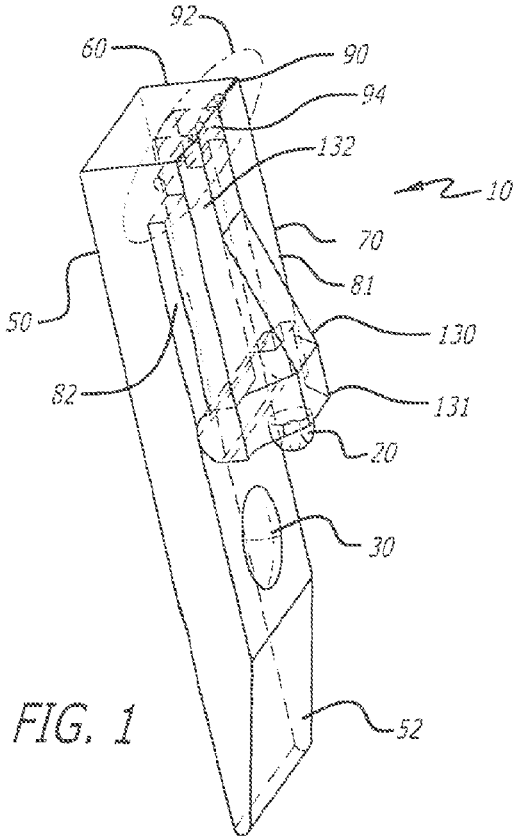
FIG. 1 shows an environmental view of a first embodiment of the present invention.
Figure 4:
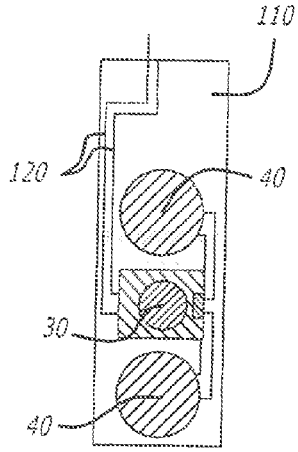
FIG. 4 shows a back view of a first embodiment of the present invention.

FIG. 1 shows an environmental view of the pocket light (10) according to a first exemplary embodiment having a single LED lamp. The LED light display (20) is located on the outer casing (70) facing in an approximate 30 degree angle from the elongated back casing (50). That is, the LED light emitting member (20) is angled relative to elongated outer member (130) such that the light from the LED projects at an outward angle of approximately 30 degrees when the outer member (130) is rotated fully downward. The angling of LED (20) relative to the outer member (130) is additionally illustrated in FIG. 8. The power switch (30) is activated by depressing the switch to activate or deactivate the LED light display (20). The power switch (30) is attached via a wiring system (FIG. 4, 120) connect to a circuit board (FIG. 4, 110) and to a pair of batteries (40). The batteries (40) are long life lithium batteries that can easily be changed through the rear protective door (100) back casing (50), as shown in FIG. 4. In this embodiment the batteries (40) are 3 volts each that supply the LED light with a total of six volts.

The back casing (50) is fixedly connected to the outer casing (70) by a clip member (60). The clip member (60) fastens across the top of a shirt pocket and can easily be concealed by a pocket flap. The clip member (60) communicates with a hinged member (90) to allow the user to move the LED light display (20) up to a 90 degree angle (FIG. 3) from the shirt pocket (not shown). The hinged member (90) can be of a conventional receptor and screw mechanism as in the arm of a pair of glasses. The clip member top (60) is fastened to the back casing (50) and is non-adjustable, and is 1/16 inch think where it communicates with the outer casing (70). The LED light display (20) is situated, in FIG. 1, at an approximate 30 degree angle from the shirt pocket and the outer casing (70), and is therefor at the correct front facing and downward angle to view documents without additional adjustments of the light. The movable pocket light (10) could also be used in alternate embodiments from a car dashboard or at a crime scene investigation to light pieces of evidence. The LED light display (20) is designed to last thousands of hours before total burn out, allowing the wearer to have long-term use of the pocket light (10).

The outer member (130) that holds the LED lamp (20) or other type of lamp is connected to the main body (50) by the hinged member (90) that rotates about hinge (94). The area where outer member (130) connects to main body (50) defines a connection zone (92), connection zone (92) being located at the respective top portions of each of main body (50) and outer member (130). An elongated clip (80), which is more clearly visible in FIG. 3, includes two clip arms (81 and 82). As seen in FIG. 1 outer member (130), when rotated downward so as to be folded toward main body (50) as shown in the figure, rests partially between clip arms (81, 82) of clip (80), contributing to the overall thinness of the design. The overall thinness of the design, including the combined thickness of the respective top portions of main body (50) and outer member (130), allows pocket light (10) to be easily worn in a shirt pocket with the outer member (130) concealed by the shirt pocket flap. As can be further seen in the figure, outer member (130) has a bottom end (131) that is thick enough to hold LED lamp (20), and has an upper end (132) that is thinner than the bottom end (131). The thinner top end (132) contributes to the ability of a shirt pocket flap to hang generally flat and downward over outer member (130). As can be also seen in the figure, main body (50) also has a tapered, chisel shaped bottom end (52). The chisel shaped bottom end allows the main body (50) to easily be inserted into a shirt pocket. As can be further seen in the figure, power switch (30) is located on the outward facing surface of main body (50) when the pocket light is inserted into pocket. The power switch (30) is located lower on main body (50) than a lowermost extension of the outer member (130), which allows the user to active power switch (30) even when the outer member (130) is rotated downward so as to be in close proximity to main body (50) as shown in the figure. That is, the lamp holding outer member (130) does not block user's access to power switch (30). As can be further seen in the figure, a distal most extent of LED (20), which is not covered in the embodiment shown, extends beyond an immediately adjacent distal most extent (134) of outer member (130). As can be yet further seen in the figure, the rotating outer member (130) which holds LED (20) proximate its distal ent (131) is about half as long as the main body (50).

As can be seen in the FIG. 1, main body (50) is generally planer, includes at least one flat surface, and is substantially thinner than it is long and wide. That is, the thickness dimension is substantially smaller than the length and width dimension. Similarly, the rotatable outer member (130) that holds the LED lamp (20) at its distal end (131) is generally planar, and is substantially thinner than it is long and wide. The distal end of LED lamp (20) defines the distal most extension of outer member (130). As can be seen from FIGS. 1 and 2 taken together, the combined main body and rotatable member are thinner than the main body is long and wide. As can be seen further in FIGS. 1 and 2, when outer member (130) is rotated downward toward its position closest to main body (50), outer member (130) lies generally parallel to main body (50).

Figure 2:
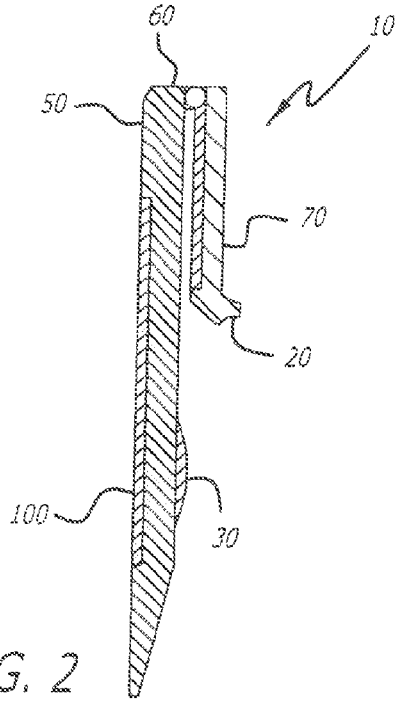
FIG. 2 shows a side view of a first embodiment of present invention.

Turning to FIG. 2 we have a clear view of the side of the pocket light (10). FIG. 2 shows the sleek design of the pocket light and the separate members as described above. The outer casing (70), clip member top (60), back casing (50), rear protective plate (100), LED display light (20) and power switch (30) of the pocket light are each shown in FIG. 2. The rear protective plate (100) protects the batteries (40) and circuit board (110) from moisture or dust. The rear protective plate (100) is easily removable to replace the batteries (40) or wiring (not shown) as necessary. The outer casing (70), back casing (50), rear protective plate (100) and clip member (80) are made of high density plastic composite, or an aluminum alloy which is water resistant and durable for extended use of the pocket light (10). In separate embodiments of the pocket light (10) the back casing (50), exterior casing (70), clip member (60) and rear protective plate (100) could be constructed in a waterproof manner.

Figure 3:
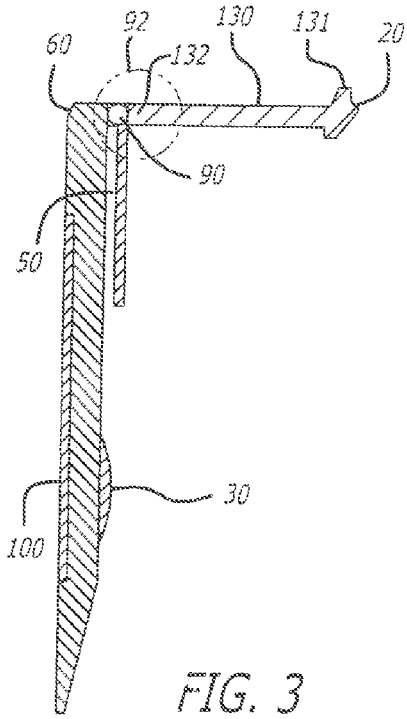
FIG. 3 shows a side view of a first embodiment of the present invention with the exterior casting extended.

FIG. 3 shows a side view of the pocket light (10) with the exterior casing (70) fully extended at an approximate 90 degree angle from the rear casing (50) and level with the clipping member top (60). The hinged member (90) allows the user to lock the exterior casing (70) in this position, or at any angle between the closes angle (FIG. 2) and the fully extended angle (FIG. 3), to allow a user to point the light at a desired angle relative to the user's body while the main body (50) of the pocket light remains within the shirt pocket. Also shown in FIG. 3 are the power switch (30), LED light display (20), rear casing (50) and rear protective plate (100) previously detailed. Clip (80) connects to main body (50), clip (80), and outer member (130) all connect together at a connection zone (92) and all extended therefrom. As can be readily inferred from FIGS. 2 and 3, when pocket light (10) is placed within a shirt pocket, main body (50) and clip (80) cooperate to hold pocket light (10) to the shirt pocket, main body (50) is disposed primarily within the pocket; outer member (130) and clip (80) are disposed primarily outside of the pocket, and connection zone (92) is disposed at the tope edge of the pocket. The connection zone (92) could rest on top of the pocket or, if clip (80) and main body (50) are sufficiently close together or the shirt fabric is sufficiently thick such that the shirt fabric is held tightly, connection zone (92) could be held slightly above the top edge of the shirt pocket fabric.

FIG. 4 shows a rear view of the pocket light (10). As is shown in the batteries (40) are covered by a rear protective plate (FIG. 2, 100), which can be removed to replace the batteries (40) as necessary. The batteries (40) are connected via wiring (120) to the power switch via circuit board assembly (110) to activate the LED display (20). The power switch (30) is touch sensitive and the user can easily activate the light through the material of a shirt pocket with a push of a finger. The wiring (120) will act as a negative and positive charge connectors from each functioning component to the batteries (40) and circuit board (110). The wiring (120) also feeds power source from the batteries (40) to the LED light display (20). The series of wiring (120) are easily manipulated without damage of the circuit board (110) or other interior components of the pocket light (10). The pocket light (20) has an automatic shut off so the LED light display (20) will burn 5 minutes and shut off to minimize depletion of the batteries (40). Alternatively, the automatic turn-off time can be adjusted by the user.

Figure 5:
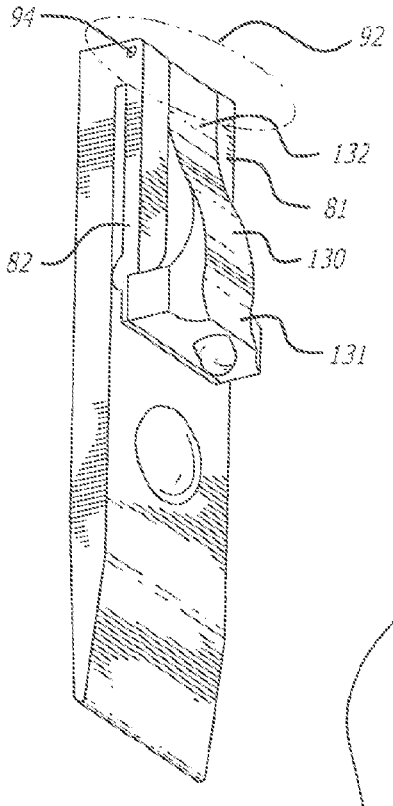
FIG. 5 is another illustration of the first embodiment of the present invention.

FIG. 5 shows the basic embodiment of FIG. 1 with minor shaped changes and all solid lines for clarity of illustration.

Figure 6:
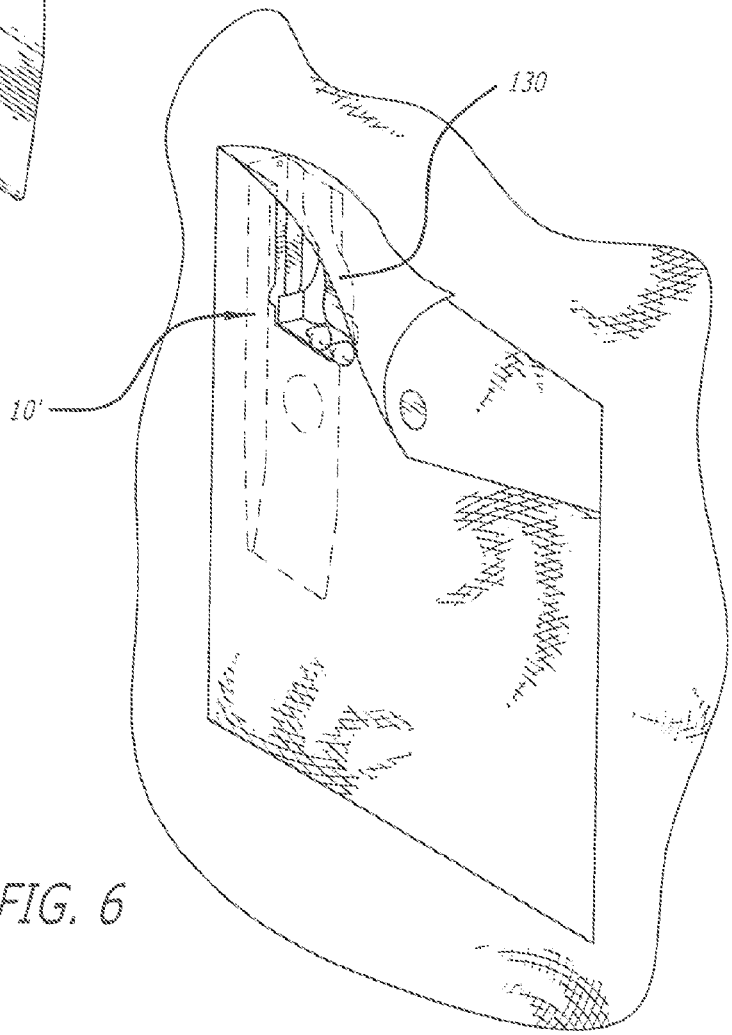
FIG. 6 is an environmental view of a second embodiment of the present invention having two LED lamps, showing the device positioned underneath a shirt pocket flap.

FIG. 6 shows a second embodiment of the invention (10) placed within a shirt pocket, with the flap of the shirt pocket partially lifted at its corner to partially reveal the device. In this embodiment, there are two separate LED lamps provided on pocket light (10). Pressing the power switch once causes one lamp to be illuminated; pressing the power switch a second time causes both lamps to be illuminated; and pressing the power switch a third time causes both lamps to turn off. As with both embodiments, the thinness of the overall design, particularly when combined with the tapered shape of outer member (130), allows the shirt pocket flap to hang over the portion of pocket light (10) that hangs outside the pocket while concealing that portion, but still allowing light from the LEDs to shine downward and slightly outward to illuminate the are immediately in front of the user such as a driver's license that a police officer is examining.

Figure 7:
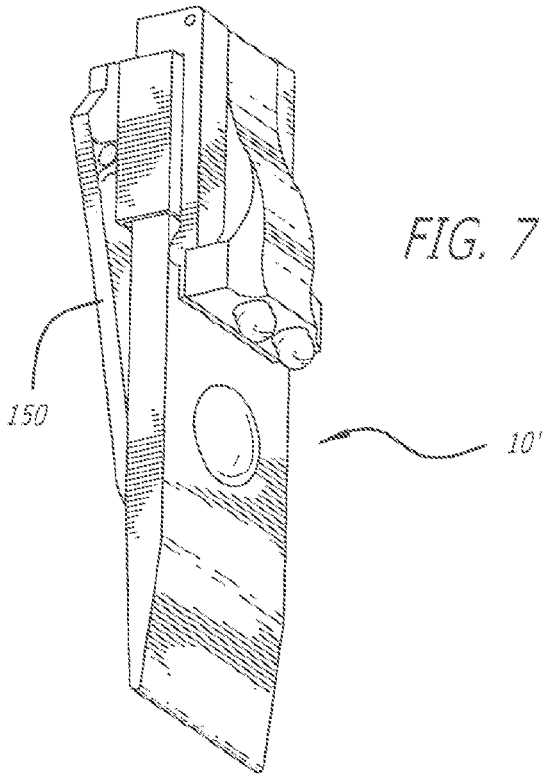
FIG. 7 is a perspective view of the second embodiment of the present invention with an optional clip.

FIG. 7 shows the embodiment of FIG. 6 with an optional detachable clip (150). As illustrated more clearly in FIG. 9, detachable clip (150) has a pair of holding arms (152 and 154) that define a receiving channel (156) for holding main body (50), preferably in a friction fit, there between. Detachable clip (150) further includes a spring biased hinge (158) and a clip arm (160) which is spring biased toward pocket light (10). Detachable clip (150) allows pocket light (10) to be firmly mounted to a wide variety of objects. As can be seen in the figure, the two LEDs, which are not covered in the embodiment shown, have respective distal most extents (23, 24) that each extend beyond the distal most extents of respective immediately adjacent portions (133,134) of outer member (131). In the embodiment shown, the distal most extents (23, 24) of the two LEDs in fact extend distally beyond any portion of outer member (131). As can be further seen in the figure, the two LEDs are mounted equidistant from hinge (94), and are also mounted equidistant from main body (50) which allows for a very low profile design. This distal most extent (23) of the LED on the left hand side of FIG. 7 is seen most clearly in FIG. 8.

Figure 8:
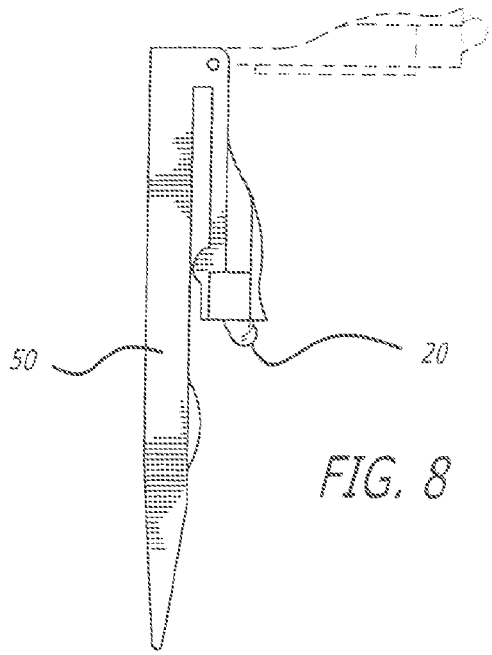
FIG. 8 is a side elevation view of the second embodiment of the present invention, with phantom lines used to illustrate the lamp portion being rotated up and away from the main body of the flashlight.
Figure 9:
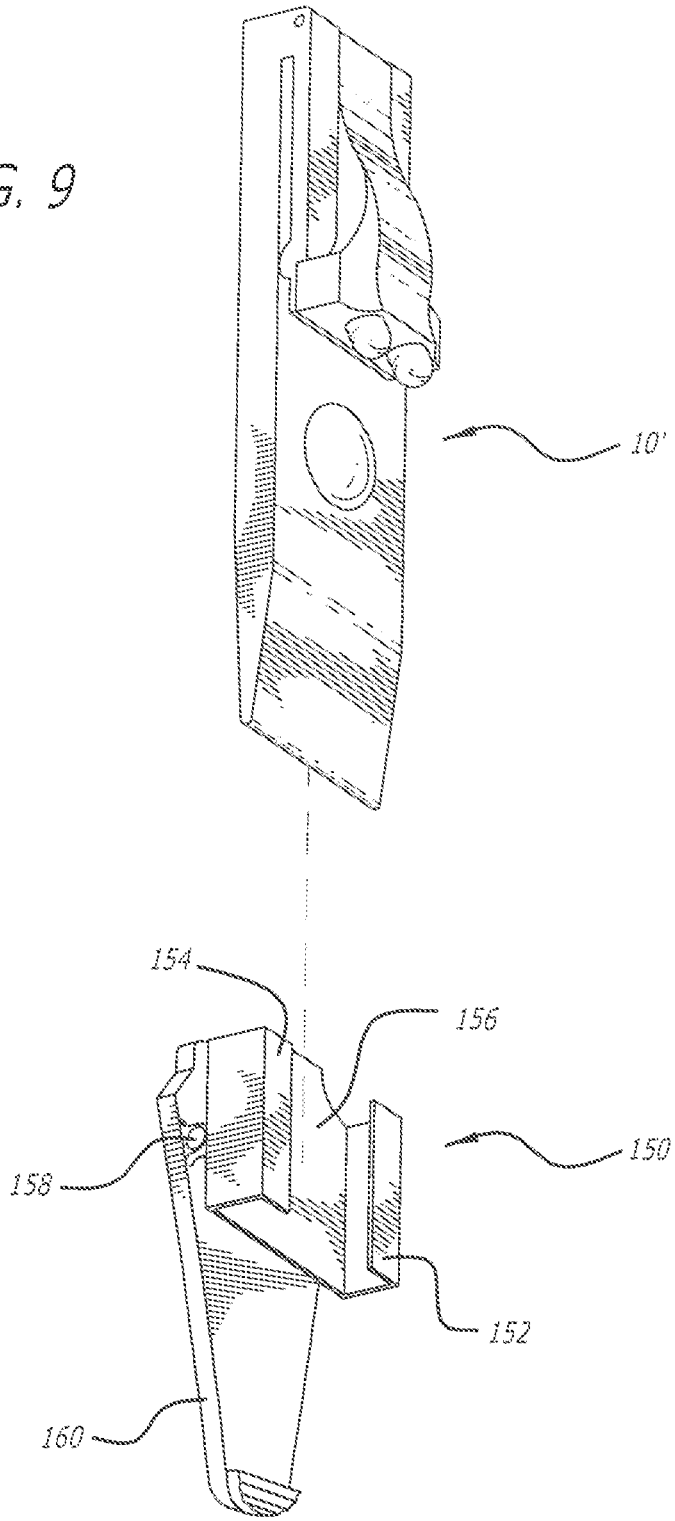
FIG. 9 is a perspective view of the second embodiment, showing the flashlight separated from the optional clip.

FIG. 8 is a side elevation view of either the pocket light (10) of FIG. 5 or the pocket light (10) of FIG. 6. The phantom lines illustrate outer member (130) rotated upward and away from main body (50).

For most consumers uses, the lamp or lamps will preferably be white LEDs. In other embodiments, however, the light source can emit other than visible light. For example, the single lamp can be a white LED, a red LED in order to help preserve a user's night vision, an infrared (IR) LED for police and military night vision purposes, or an ultraviolet (UV) LED. A UV LED can be useful for a bouncer to view hands stamped with UV visible ink, for a police officer to view the UV visible ink used in driver's licenses, and many other purposes in which UV light is desired. The dual LED embodiment can use any combination of the foregoing types of lamps, with the sequential activation feature allowing the user to cycle between the different types of lights. In such a sequential activation of different types of lights, in most cases it would be desirable to cycle through the sequence of one type of lamp being on, the other type of lamp being on, and neither lamp being on, and would probably be undesirable in most cases, although not necessarily all cases, to include a state in which lamps of different types are turned on simultaneously. The invention is not limited to use of only one or two lamps, but could include any combination of lamps being sequentially activated, such as a white LED, a red LED, an IR LED, and then a UV LED in any sequence, or activated by two or more switches. Of course, the lamps need not be LEDs, and could be other types of light emitting members including light emitting members that have not yet been invented or have not yet come into widespread use.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptions and modifications of the present invention may be accomplished without departing from the spirit and scope of the invention. For example, the lamp could be another type of light emitting member other than an LED, different types of batteries could be used, different materials could be used, and other modifications may be made that would be within the skill of a mechanical designer and/or electrical designer. Accordingly, it is to be understood that the detailed description and the accompanying drawings as set forth herein above are not intended to limit the breadth of the present invention, which should be inferred only from the following claims and their appropriately construed legal equivalents.

While several particular forms of the invention have been illustrated and described, it will be apparent that various modifications can be made without departing from the spirit and scope of the invention. Therefore, it is not intended that the invention be limited except by the following claims. Having described my invention in such terms as to enable a person skilled in the art to understand the invention, recreate the invention and practice it, and having presently identified the presently preferred embodiments thereof,

I claim:

1. A flashlight comprising:

a main body for holding a battery, the main body being elongate and having first and second ends defining a first axis, the main body being thinner than it is wide;

a rotatable member that is thinner than it is long and wide, is shorter than the main body, and is rotatably connected to the first end of the main body to allow the rotatable member to be rotated about a second axis perpendicular to the first axis to direct light in a desired direction relative to the main body; and a light source mounted proximate a distal end of said rotatable member.

2. The flashlight of claim 1 further comprising a clip adapted to clip to a wearer's clothing such that when the flashlight is clipped thereto, the rotatable member can be rotated so as to direct light in a desired direction in front of the wearer.

3. The flashlight of claim 1 further comprising a clip adapted to clip to a wearer's clothing wherein the clip is attachable and detachable from said main body without tools.

4. The flashlight of claim 1 further comprising a clip adapted to clip to a wearer's clothing wherein the clip includes a pair of arms to attach and detach said clip to and from said main body in a press-fit arrangement.

5. The flashlight of claim 1 further comprising a clip adapted to clip to a wearer's clothing wherein said clip is adapted to clip to a shirt pocket of a wearer such that the main body is disposed primarily within the pocket and the rotatable member is disposed primarily outside the pocket, and the rotatable member can be rotated to direct light in a desired direction in front of the wearer.

6. The flashlight of claim 5 further wherein the rotatable member rotates sufficiently far downward such that when the flashlight is in said pocket and clipped thereto, the wearer can rotate the rotatable member to a position in which light is directed outward from the wearer and downward from the pocket.

7. The flashlight of claim 1 wherein the main rotatable member is about half as long as the main body.

8. The flashlight of claim 1 wherein the main body has a chisel shaped bottom end.

9. The flashlight of claim 1 wherein the light emitting diode (LED) comprises a single LED.

10. The flashlight of claim 1 wherein the light emitting diode (LED) is uncovered.

* * * * *